United States Patent [19]

Slevin

[11] Patent Number: 4,866,953

[45] Date of Patent: Sep. 19, 1989

[54] SUPPORT FOR KNITTING NEEDLES

[76] Inventor: Helen M. Slevin, 3994 Chestnut Ave., Concord, Calif. 94519

[21] Appl. No.: 226,830

[22] Filed: Aug. 1, 1988

[51] Int. Cl.[4] ..... D04B 3/02

[52] U.S. Cl. ..... 66/1 A; 66/117; 223/108

[58] Field of Search ..... 66/1 A, 117; 223/108, 223/109 R, 109 A

[56] References Cited

U.S. PATENT DOCUMENTS

| | | | |
|---|---|---|---|
| 1,772,666 | 8/1930 | Housh | 66/117 |
| 2,461,816 | 2/1949 | Giovanini | 66/1 A X |
| 2,504,350 | 4/1950 | Reeves | 66/117 X |
| 3,084,788 | 4/1963 | Ford | 223/108 X |

FOREIGN PATENT DOCUMENTS

| | | | |
|---|---|---|---|
| 692158 | 6/1940 | Fed. Rep. of Germany | 66/117 |
| 3633665 | 4/1988 | Fed. Rep. of Germany | 223/109 R |
| Ad. 9974 | of 1891 | United Kingdom | 223/109 R |
| 828063 | 2/1970 | United Kingdom | 66/117 |

*Primary Examiner*—Wm. Carter Reynolds
*Attorney, Agent, or Firm*—Schapp and Hatch

[57] ABSTRACT

A knitting needle holder apparatus having flattened holder members mounted at the ends of a flexible base strap, and knitting needles having spherical balls formed on their blunt ends fitting tightly into sockets formed in the knitting needle holders so that, when the user is sitting upon the strap, the knitting needles will be supported in the correct knitting position. Adjustment strips of interlocking plastic hooks and loops are provided for adjusting the distance between the needle holders to accommodate different lengths of needles.

6 Claims, 1 Drawing Sheet

SUPPORT FOR KNITTING NEEDLES

BACKGROUND OF THE INVENTION

1. Field of the Invention

This invention relates to hand knitting, and more particularly to devices for facilitating hand knitting by at least partially supporting the weight of the knitting needles and the knitted work.

2. Description of the Prior Art

Various types of single needle "holders" are known. Typical of these is the holder found in U.S. Pat. No. 2,461,816. Generally speaking, the prior art needle holders usually comprise a short stick through which the needle is inserted, with the stick being adapted to be tucked into the belt of the user. Typically, this type of holder is used to support a third needle when the user is knitting a tubular piece of clothing such as a sock. The other two knitting needles are manipulated in the usual manner.

Another well known type of knitting needle holder is a leather device, again worn on the belt of the user. The leather device is provided with a plurality of openings extending therethrough at different angles for holding the needle at different angles to accomodate the physical characteristics and techniques of the knitter. Another knitting needle holder comprises a crocheted pouch with elasticized opening to accomodate many sizes of "heads" of conventional knitting needles. The pouch is attached to a finger ring, or bracelet, by a cord or chain and can be adjusted into proper length by tying a knot in the cord at the appropriate place.

All of the known needle holders are adapted for use only with a single, conventional 14 inch long needle and, at best, supply only minimal partial support for the work.

It is highly desirable to be able to produce a very wide seamless piece of knitted work. Conventionally, relatively narrow pieces are knitted on a pair of 14" standard needles, and the resulting strips or panels are then sewn or crocheted together. The width of a seamless piece of knitted work is limited by the number of stitches the user can "cast on" a knitting needle.

Relatively wide panels of knitted work are sometimes produced on circular knitting needles, but the desired speed of knitting is not possible with circular knitting needles because they cannot be used with a holder.

SUMMARY OF THE INVENTION

The present invention provides an aid to speedy and comfortable hand-knitting of items, in one piece, of much greater width than is possible with conventional 14" needles. The apparatus of the present invention provides a pair of knitting needle holders, attached to an expandable base, which are capable of accomodating both conventional length (14") straight knitting needles and, most importantly, straight knitting needles of two, three or more times the length of the conventional straight knitting needles, the apparatus providing the desired support for both knitting needles and the work being knitted.

The conventional knitting needle holder relieves one hand of supporting the weight of the work, while my apparatus relieves both hands, freeing them to control only the yarn and needle points, thus facilitating speed and increasing comfort while at the same time permitting use of extra-long straight knitting needles to achieve a seamless extra wide item, i.e., an afghan, tablecloth, bedspread, etc.

By relieving the hands of the weight of the knitting needles and knitted work, comfort is greatly increased, which is a boon to knitters having arthritic hands or fingers, hands or fingers weakened by other diseases or accidents, missing fingers, etc.

The knitting-needle holder/base of my invention can be used over or under the knitter's lap, so as to firmly maintain the knitting needles in the desired position. Basically, the elongated base is preferably in the form of an elongated flexible strap adapted to be sat upon and held in desired positions by the body of the user. Flattened holder members are attached to and extend from the opposite ends of the strap, and the holder members are provided with sockets formed for mating engagement with enlargements on the non-pointed ends of the knitting needles. Preferably, the enlargement and cooperating socket provide a ball joint which holds the needle securely, but permits its re-adjustment to the most comfortable position for the particular knitter.

The base is adapted for use with knitting needles of various sizes and, accordingly, is provided with a plurality of sockets of different sizes to accomodate balls of different sizes formed on different sizes of knitting needles. To further adapt the present apparatus to needles of different lengths, the elongated flexible base strap is provided with adjustment means for selectively lengthening or shortening the distance between the holder members. Preferably, this adjustment means is provided by forming the strap in two parts and providing on one end of the strap a length of material covered with tiny plastic hooks which releasably engage with a plurality of loops on the confronting face of a second strip of material secured to the other portion of the belt. These hook and loop fasteners hold the strips securely together, but can be pulled apart and then re-engaged in different positional relationships.

It is therefore a principal object of the present invention to provide apparatus for supporting each of a pair of knitting needles and the work thereon in such manner as to facilitate and make easier the knitting operation.

Another object of the present invention is to provide a support for knitting needles of the character described which is capable of being held firmly in place by being sat upon by the knitter.

A further object of the present invention is to provide knitting needle apparatus of the character described which is capable of being used with elongated knitting needles of various lengths and diameters by persons of different sizes.

Other objects and features of advantage will become apparent as the specification progresses and from the claims.

Figure 1:
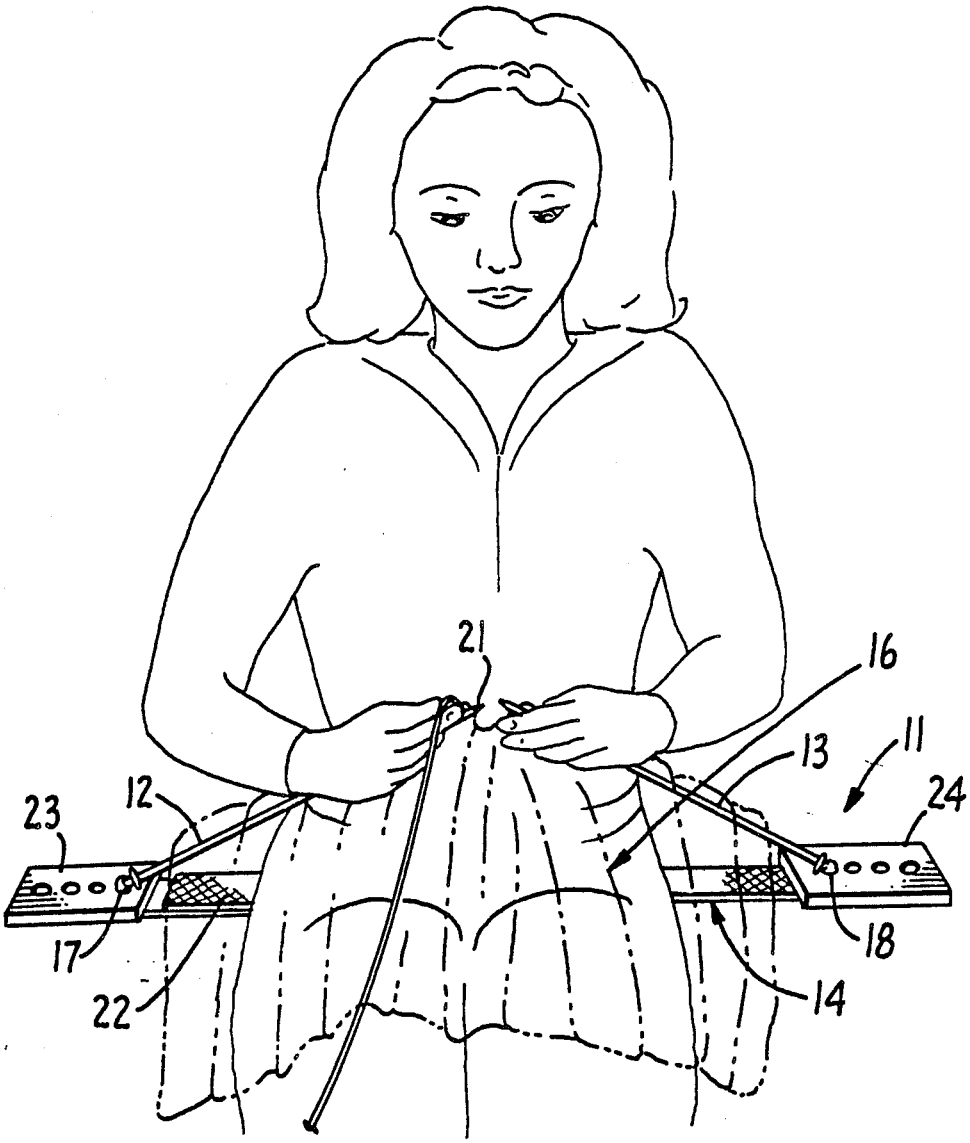
FIG. 1 is a perspective view of the apparatus constructed in accordance with the present invention and being utilized for knitting a broad panel in the manner described.

While only the preferred forms of the invention are illustrated in the drawings, it will be apparent that various modifications could be made without departing from the ambit of the claims.

DESCRIPTION OF THE PREFERRED EMBODIMENTS

As may be seen in the accompanying drawings, the support 11 for knitting needles 12 and 13 provides a flexible, elongated base 14 adapted to be held in desired positions by the body 16 of the user, the base 14 being formed with spaced openings 17 and 18, with each opening being adapted for receiving and grasping an enlarged end 19 of a knitting needle, such as knitting needle 12, so as to support the opposite pointed end 21 of such knitting needle in desired spaced relation to the base 14 and to other knitting needles supported on base 14, such as knitting needle 13.

In accorance with the present invention, the flexible base 14 is elongated, with the central portion 22 formed of flexible material and with the end portions 23 and 24 providing holding members formed of relatively inflexible material, such as plastic or leather, with the openings 17 and 18 being provided in the end portions 23 and 24, respectively.

Preferably, and as here shown, a plurality of the openings 17, 18 are formed in each of the end portions 23, 24 and these openings are of graduated sizes for accomodating different sizes of spherical enlargements of balls 19 on the blunt ends of the knitting needles with which the apparatus is used. In this manner, knitting needles of different lengths and diameters are accomodated, it being noted that the openings 17 have spherical inner surfaces into which the balls 19 are snapped. The tolerances and materials are such that the needles are frictionally supported in the desired position, but can be forcibly moved to other positions when required.

As an important feature of the invention, adjustment means 26 is provided on the flexible strap 14 for selectively varying the spacing between the holder members 23 and 24. When longer needles are to be used, the adjustment means permits moving for the particular length of needles being used. Likewise, the adjustment means 26 permits the central portion 22 of the flexible strap 14 to be shortened, bringing the holder members 23 and 24 closer together to accomodate shorter needles.

Figure 2:
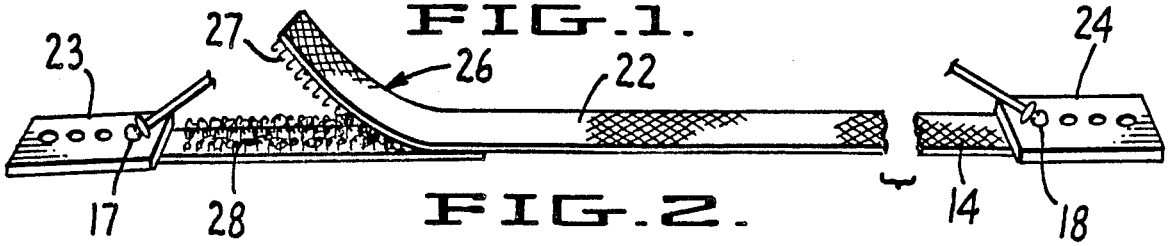
FIG. 2 is a perspective view of a flexible strap base constructed in accordance with the present invention and having means for adjusting the distance between flattened needle holders at the ends of the strap.
Figure 3:
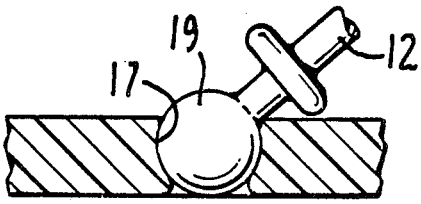
FIG. 3 is a vertical cross-sectional view on an enlarged scale of a ball and socket joint provided by a modified knitting needle and by the knitting needle holder member.

The adjustment means 26 here comprises strips of interlocking hook material 27 and loop material 28 interposed in the flexible strap 14. As shown in FIG. 2 of the drawings, the adjustment means 26 is provided adjacent to one of the holder members, such as holder member 23, to avoid lumps and protrusions in the central area 22 of the strap 14 which could interfere with the comfort of the knitter sitting upon the strap.

From the foregoing, it should be apparent that the knitting needle holder apparatus of the present invention provides a novel and extremely valuable supporting action for extra long knitting needles making them capable of producing wide panels of knitted material while at the same time facilitating and speeding up the knitting operation with increased comfort to the user.

What is claimed is:

1. A support for knitting needles, comprising an elongated flexible strap, holder members of flattened form attached to and extending from the opposite ends of said strap, and elongated knitting needles each having a spherical ball portion formed on one end and a point formed on the opposite end, said holder members being formed with sockets rotatably receiving and frictionally securing said ball portions on the ends of said knitting needles in their respective sockets.

2. A support for knitting needles as described in claim 1, and wherein a plurality of said sockets are formed in each of said holder members, and said sockets are of graduated sizes for accomodating different sizes of balls on said knitting needles.

3. Knitting needle apparatus, comprising plurality of elongated knitting needles each having a point at one end and an enlargement at the opposite end, an elongated flexible strap adapted to be sat upon and held in desired positions by the body of a user, flattened holder members attached to and extending from the opposite ends of said strap, said holder members being provided with sockets formed for mating engagement with said enlargements on said knitting needles for holding said needles in position for knitting with said needles and the knitted material thereon supported by said holder members.

4. Knitting needle apparatus as described in claim 3, and wherein adjustment means is provided on said flexible strap for selectively varying the spacing between said holder members.

5. Knitting needle apparatus as described in claim 4, and wherein said strap is in two parts and said adjustment means comprises strips of interlocking hook material and loop material with each of said strips secured to one of said two parts of said strap.

6. A support for knitting needles, comprising a flexible base adapted to be held in desired positions by the body of the user, said base being formed with spaced openings with each such opening adapted for receiving and grasping an enlarged end of a knitting needle so as to support the opposite pointed end of such knitting needle in desired spaced relation to said base and to other knitting needles supported on said base, said base being elongated with the central portion thereof formed of flexible material and with the end portions thereof formed of relatively inflexible material, said openings being formed in said end portions, a plurality of said openings being formed in each of said end portions with said openings being of graduated sizes for accommodating different sizes of said enlarged ends on said knitting needles.

* * * * *